US005167334A

United States Patent [19]

Kanjo et al.

[11] Patent Number: 5,167,334

[45] Date of Patent: Dec. 1, 1992

[54] APPARATUS TO PROVIDE VERSATILITY IN SECURING MALE AND FEMALE CONNECTION MEMBERS OF AN ARTICULATED COUPLER TO A CENTER SILL MEMBER OF A RAILWAY CAR

[75] Inventors: Wajih Kanjo, Lockport, Ill.; Michael G. Hawryszkow, Munster, Ind.; William D. Wallace, Chicago; David W. Daugherty, Jr., Bolingbrook, both of Ill.

[73] Assignee: Westinghouse Air Brake Company, Wilmerding, Pa.

[21] Appl. No.: 588,604

[22] Filed: Sep. 26, 1990

[51] Int. Cl.[5] ..... B61G 7/10

[52] U.S. Cl. ..... 213/61; 213/62 R; 213/75 R

[58] Field of Search ..... 105/3, 4.1, 4.2; 213/61, 62 R, 62 A, 75 R

[56] References Cited

U.S. PATENT DOCUMENTS

| | | | |
|---|---|---|---|
| 2,262,076 | 11/1941 | Wolfe | 213/57 |
| 2,355,524 | 8/1944 | Garlock et al. | 213/57 |
| 2,633,250 | 3/1953 | Blattner et al. | 213/57 |
| 2,703,181 | 3/1955 | Nystrom | 213/57 |
| 3,716,146 | 2/1973 | Altherr | 105/4.3 |
| 4,258,628 | 3/1981 | Altherr | 105/4 R |
| 4,336,758 | 6/1982 | Radwill | 213/75 R |
| 4,593,829 | 6/1986 | Altherr | 213/75 R |
| 4,867,071 | 9/1989 | Weber | 105/4.1 |
| 5,005,715 | 4/1991 | Solomon | 213/62 A |

OTHER PUBLICATIONS

Maintenance Manual for ASF Articulated Connection Assembly, Nov. 1986.

*Primary Examiner*—Robert J. Oberleitner
*Assistant Examiner*—Kevin D. Rutherford
*Attorney, Agent, or Firm*—J. O. Ray, Jr.

[57] ABSTRACT

An apparatus which provides versatility in securing an articulated coupling arrangement to a center sill member of a railway car is provided. Such apparatus includes a bottom wall portion which matingly engages a bottom wall of such center sill member and a top wall portion which matingly engages one of a top wall of such center sill member and a bottom surface of such railway car. A pair of vertically disposed side wall portions are disposed between such top wall portion and such bottom wall portion. Each of such pair of side wall portions have a predetermined configuration which provides such enhanced versatility in securing such articulated coupling arrangement to such center sill member.

17 Claims, 2 Drawing Sheets

APPARATUS TO PROVIDE VERSATILITY IN SECURING MALE AND FEMALE CONNECTION MEMBERS OF AN ARTICULATED COUPLER TO A CENTER SILL MEMBER OF A RAILWAY CAR

FIELD OF THE INVENTION

The present invention relates, in general, to articulated-type coupling arrangements which are used to connect one end of a first railway car to an adjacent end of a second railway car in a substantially semi-permanent manner and, more particularly, this invention relates to an apparatus which will provide greater flexibility in securing a male connection member and a female connection member to the center sill portion at adjacent ends of respective railway cars to form an articulated coupling arrangement.

BACKGROUND OF THE INVENTION

Coupling devices have been used extensively for many years in the railroad industry to connect adjacent ends of a pair of railway cars together to form a train consist of several cars. On those railway cars which will be used in interchange service, however, such coupling devices must receive approval from the Association of American Railroads (AAR) before they can be installed on the cars. It has come to be quite well known, in this railway application, that such coupling devices perform a number of important functions. Obviously, an important function of the standard coupling device is that it facilitates the connection and disconnection of individual cars to and from, respectively, a train consist. Another important function of a standard coupler is that it enables such railway cars to negotiate the various curved portions of the track structure which are encountered during operation. Further, these coupling devices will enable a number of cars to be readily combined so that a train consist can be made up, or such cars can be easily separated individually for either loading or unloading cargo thereto or therefrom, respectively, as required. This will allow a railroad to leave a particular car at a customer's plant while delivering or picking up other cars at other locations.

In more recent times, the railroad industry has come to recognize, however, that a number of rather significant advantages can be achieved by the interconnection of several railway cars together to form a generally semi-permanent unit. This is particularly the case, for example, where such individual railway cars are adapted for use in what is commonly known in the railroad industry as "piggyback" service. A primary reason for this is that the cargo to be either loaded or unloaded is brought to or removed from, respectively, a central location which is owned and operated by the railroad normally. Generally, this cargo is either over-the-road trailers or very large containers to be shipped by sea. The individual cars which have been connected together in such substantially semi-permanent fashion are commonly known in the railroad industry as a "10-pack". These 10-pack units do not require the use of standard couplers except at each outer end of each 10-pack unit. The primary reason why such standard coupling devices are not required is that in view of their dedicated service these 10-pack units will only be broken periodically. For example, this will normally only occur when maintenance must be carried out on an individual coupler component or on some other component positioned on such railway cars that will necessitate such car be taken out of service at least temporarily. It has become obvious to the railroad industry that with the use of this coupling arrangement it is possible for them to achieve a significant reduction in their costs. Such cost-savings can be attributed to a number of reasons. For example, these reasons include lower equipment weight which results in enhanced energy savings and fewer railway trucks which results in both lower equipment cost as well as a significant reduction in maintenance requirements. However, now with the rather extensive use of these semi-permanent coupling arrangements, particularly with new cars being built for piggyback service, and with the ever increasing loads that are now being carried by modern railway cars and trains, it has been determined that it is of the utmost importance for a close-buttoned relationship to be maintained between the draft components of the coupler devices. Such close-buttoned relationship is necessary, for example, so that the effects of the impact forces, which are usually encountered under normal buff conditions during train operation, can be reduced to an acceptable level. In this manner, unnecessary damage to both cargo and rolling equipment can be held to a minimum.

Taught in U.S. Pat. No. 4,258,628, is one prior art type of articulated coupling apparatus which can be used for the above-identified purpose of connecting adjacent ends of a pair of railway cars together in such semi-permanent manner. This particular articulated coupling arrangement, as taught and illustrated therein, includes a male connection member secured to one end of a first railway car body and a female connection member which is secured to an adjacent end of a second railway car body. However, as can be seen the ends of both the male connection member and the female connection member which are secured to such car bodies do not provide any flexibility in how they are attached to such car body. The female connection member is rotatably-engaged in a center plate bowl portion of the bolster of a railway car truck in this prior art arrangement. This rotatable engagement is carried out in a manner that is well known in the railway art. The outer end portion of the male connection member is disposed for movement within a cavity formed in the outer end portion of such female connection member. To connect both the male connection member and the female connection member together in such semi-permanent manner, a pin member is utilized. This pin member is positioned in a vertical direction and is disposed in axially aligned apertures which are formed in each of the male connection member and the female connection member.

As taught in this reference, the aperture which is formed in such male connection member for receiving the pin member therein must be somewhat larger than the pin member itself. This larger aperture is required so that, while in operation, certain required movements of the coupling arrangement can be achieved. Additionally, a rear surface portion of such aperture that is located in such male connection member and which receives the pin member therein has a horizontally disposed concave configuration and a vertically disposed convex configuration. This particular configuration is required because it enables both the male connection member and the female connection member to move in each of a horizontal direction and a vertical direction in relationship to one another. Furthermore, this configuration provides, at the same time, a relatively substantial area of surface contact between the rear surface area of such pin aperture and the pin member itself.

The outer end surface of the outer end portion of such male connection member is provided with a convex configuration. This convex configuration abuttingly engages a complimentary concave surface which is formed on a front face portion of a follower member. In this coupling arrangement, such follower member is carried within the rear portion of such cavity disposed in the outer end portion of such female connection member. A pair of vertically disposed, slot-like cavities are provided on such follower members adjacent the rear surface thereof.

A first portion of a resilient member is disposed within each of such vertical slot-like cavities. A second portion of each such resilient member extends outwardly from such rear face portion of the follower member. In this manner, a portion of the exposed outer surface of each such resilient member can be engaged by a vertically disposed wedge-like element. This wedge-like element must be provided in this prior art coupling arrangement to urge both the follower member and the male connection member forward.

When this occurs the rear surface portion of the aperture formed in the outer end of the male connection member will be maintained substantially in contact with the pin member at all times.

This contact between such pin member and the rear surface portion of such aperture in the male connection member is absolutely necessary in this coupling arrangement because most of the articulated connecting members are manufactured as cast components. Consequently, in order for the manufacturer to achieve any significant reduction in the cost of this coupling device, such cast articulated connecting members receive very little, if any, finish-type machining which could provide the necessary and desirable dimensional control. In other words, these cast connecting members will generally be assembled into such coupling device as cast. Therefore, as a result of this cost-saving practice, it is quite often very difficult to provide an articulated coupling device which will be self-adjusting under the various wear conditions that will be encountered by such coupling device during in-track operation. Nevertheless, it is of the utmost importance to minimize the slack encountered in the various coupling connections during such in-track service for the reasons discussed above.

Other prior art-type articulated coupling arrangements are taught in U.S. Pat. No. 3,716,146 and Canadian Patent number 1,231,078. However, the shortcomings which are overcome by the invention to be taught hereinafter are also found in these prior art references.

SUMMARY OF THE INVENTION

An apparatus is provided by the present invention which greatly enhances the versatility in connecting at least one of a male connection member and a female connection member forming a portion of an articulated coupling arrangement to one outer end of a center sill member disposed along a longitudinal axis of a railway car body. Such apparatus includes a bottom wall portion, a top wall portion and a pair of axially opposed side wall portions. The bottom wall portion has a predetermined length which extends inwardly from an outer edge of the center sill member and a predetermined width which is substantially identical to an inner width of the center sill member. Further, such bottom wall portion includes a substantially flat bottom surface which matingly engages an upper surface of a horizontally disposed bottom wall of such center sill member. A first edge portion of such bottom wall portion is engageable with and secured to an inner portion of such at least one of the male connection member and the female connection member. An axially opposed second edge portion of the bottom wall portion defines one extreme outer edge of such at least one of the male connection member and the female connection member adjacent a lower portion thereof. The top wall portion also has a predetermined length which extends inwardly from such outer edge of the center sill member. The predetermined length of such top wall portion is substantially shorter than the predetermined length of such bottom wall portion. The predetermined width of such top wall portion is substantially identical to such inner width of the center sill member. A substantially flat upper surface of such top wall portion is disposed such that it matingly engages at least one of a bottom surface of a horizontally disposed top wall portion of the center sill member and a bottom surface of such railway car body. The top wall portion also has a first edge portion which is engagable with and secured to an inner portion of such at least one of the male connection member and the female connection member. Further, an axially opposed second edge portion of such top wall portion of the apparatus defines another extreme outer edge of such at least one of the male connection member and the female connection member adjacent an upper portion thereof. The apparatus of this invention further includes a pair of axially opposed side wall portions. Each of such pair of side wall portions has a predetermined configuration which provides greatly enhanced versatility in securing such at least one of the male connection member and the female connection member to such center sill member during the installation of the articulated coupling arrangement to the railway car body. Each of such pair of side wall portions has a first edge portion thereof which is engageable with and secured to an inner portion of such at least one of the male connection members and the female connection member. A second edge portion of each of such pair of side wall portions is engageable with and secured to an upper surface of the bottom wall portion adjacent a respective outer edge thereof. Such each of such pair of side wall portions include a third edge portion which is engageable with and secured to a bottom surface of the top wall portion adjacent a respective outer edge thereof. Finally, each of such pair of side wall portions has a fourth outer edge portion. Such fourth outer edge portion in conjunction with the first edge portion and the second edge portion and the third edge portion, defines such predetermined configuration. A predetermined portion of a respective outer surface of each of such pair of side wall portions matingly engages an inner surface of a respective vertically disposed side wall portion of such center sill member.

OBJECTS OF THE INVENTION

It is, therefore, one of the primary objects of the present invention to provide both a male connection member and a female connection member of an articulated coupling apparatus in which one end thereof is specifically designed to provide enhanced versatility in connecting such one end to a center sill member disposed along a longitudinal axis of a railway car.

Another object of the present invention is to provide a specifically designed end portion of a male connection member and a female connection member of an articulated coupling apparatus which will provide a stronger connection to a center sill member of a railway car.

Still another object of the present invention is to provide a specifically designed end portion of a male connection member and a female connection member of an articulated coupling apparatus which will be easier for a car builder and/or car repair shop to install in the center sill portion of the railway car.

Yet another object of the present invention is to provide a specifically designed end portion of a male connection member and a female connection member of an articulated coupling apparatus which will not add any significant weight to such articulated coupling apparatus.

A further object of the present invention is to provide a specifically designed end portion of a male connection member and a female connection member of an articulated coupling apparatus which will be cost effective.

An additional object of the present invention is to provide a specifically designed end portion of a male connection member and a female connection member of an articulated coupling apparatus which can be retrofitted into the center sill portion of existing railway cars.

Another object of the present invention is to provide a specifically designed end portion of a male connection member and a female connection member of an articulated coupling apparatus which will require little or no maintenance over the life of an articulated coupling apparatus.

Still another object of the present invention is to provide a specifically designed end portion of a male connection member and a female connection member of an articulated coupling apparatus which can be used in a number of differently designed articulated coupling arrangements.

Yet another object of the present invention is to provide a specifically designed end portion of a male connection member and a female connection member of an articulated coupling apparatus which can have a number of configurations while still providing enhanced versatility in connecting such end portions to the center sill of a railway car.

In addition to the above described objects and advantages of the present invention, various other objects and advantages of the specifically designed end portion of the male connection member and the female connection member of an articulated coupling apparatus will become more readily apparent to those persons who are skilled in the railway coupling art from the following more detailed description of the invention, particularly, when such description is taken in conjunction with the attached drawings and with the appended claims.

BRIEF DESCRIPTION OF THE INVENTION

Figure 1:
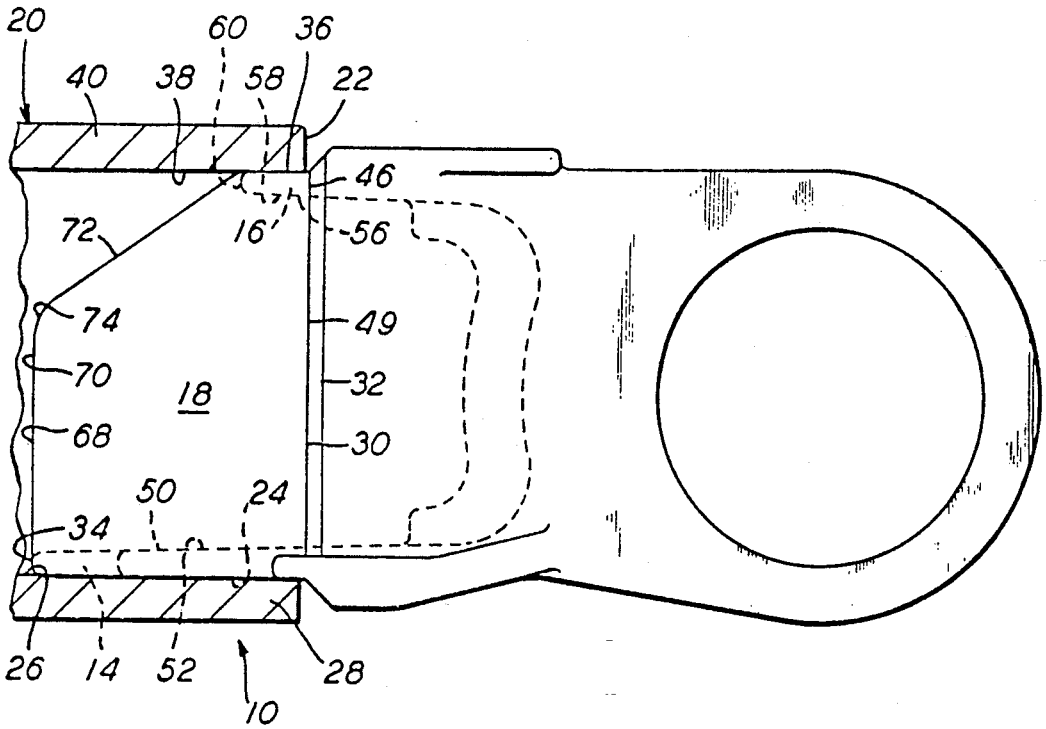
FIG. 1 is a fragmented side elevation view with portions in cross-section of a presently preferred embodiment of the apparatus to enhance versatility in securing an articulated coupling arrangement to a center sill members on a railway car body.

Prior to proceeding to the more detailed description of the apparatus to provide greatly enhanced versatility in securing at least one of a male connection member and a female connection member, of an articulated coupling apparatus, to a center sill member of a railway car body, it should be noted that, for the sake of clarity and understanding, identical components having identical functions have been identified with identical reference numerals.

Although the apparatus of the present invention is not limited thereto it will be particularly useful in the articulated coupling apparatus disclosed in our co-pending patent applications Ser. Nos. 07/520,686 and 07/520,687 which were filed May 8, 1990. The disclosure of each of patent applications Ser. Nos. 07/520,686 and 07/520,687 is incorporated herein by reference thereto.

Figure 2:
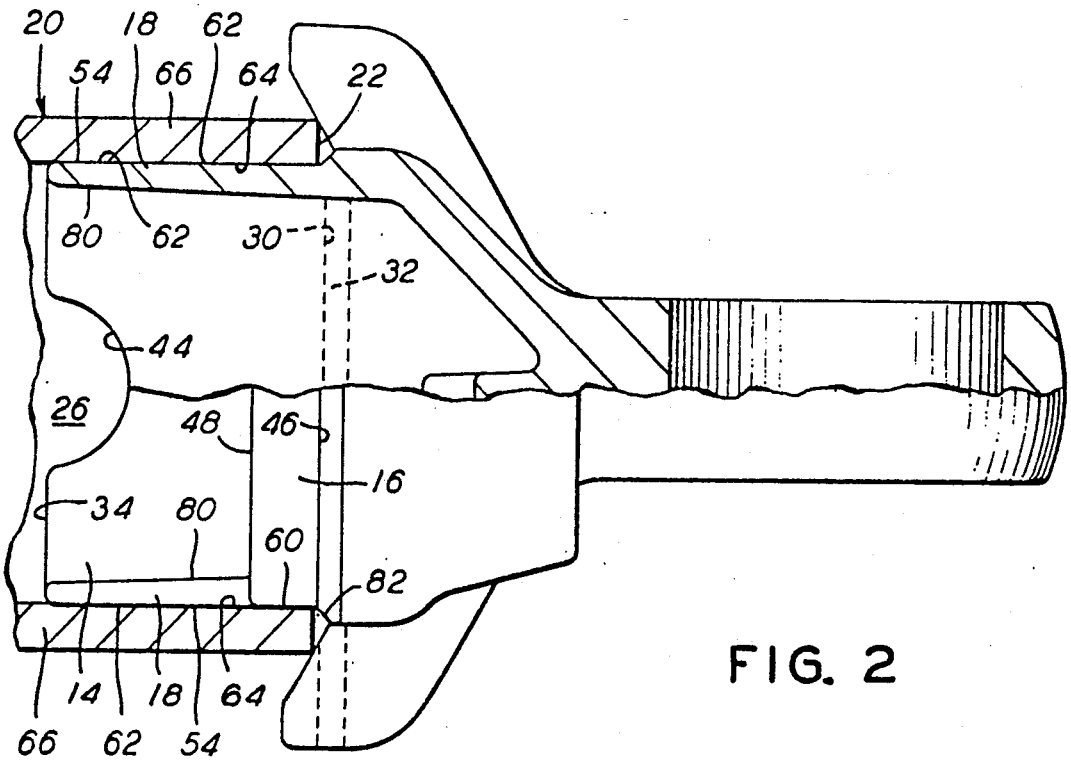
FIG. 2 is a fragmented top view of the apparatus illustrated in FIG. 1 partially in cross-section.
Figure 3:
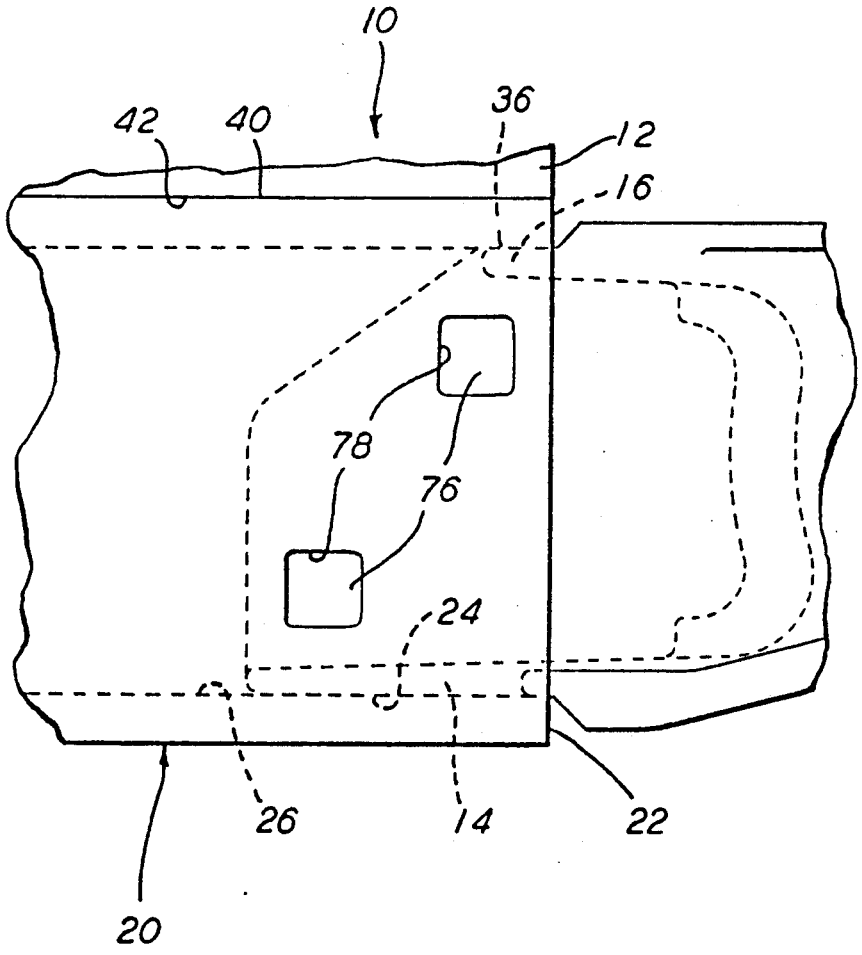
FIG. 3 a fragmented side elevation view, which illustrates the apparatus shown in FIGS. 1 and 2 secured to a center sill member of a railway car body.

Now reference is made to FIGS. 1 through 3 in which there is illustrated the presently preferred embodiment of the instant invention. Shown therein is an apparatus, generally designated 10, which provides both railway car builders and car repair centers greatly enhanced versatility in the manner in which they secure at least one of a male connection member (not shown) and a female connection member (not shown) to an outer end of a center sill member, generally designated 20, disposed along a longitudinal axis of a railway car body 12. The male connection member and the female connection member are each a part of an articulated coupling arrangement (not shown). According to the present invention, the apparatus 10 includes a bottom wall portion 14, a top wall portion 16 and a pair of axially opposed side wall portions 18.

The bottom wall portion 14 of apparatus 10 has a predetermined length which extends inwardly into such center sill member 20 from an outer edge 22 thereof. A predetermined width of such bottom wall portion 14 is substantially identical to an inner width of such center sill member 20. Also, such bottom wall portion 14 has a bottom surface 24 which matingly engages an upper surface 26 of a horizontally disposed bottom wall or plate 28 of such center sill member 20. The bottom surface 24 of the bottom wall portion 14 of apparatus 10 and the upper surface 26 of the bottom wall 28 of center sill member 20 are both substantially flat across their entire engaging surfaces. Additionally, the bottom wall portion 14 of apparatus 10 includes a first edge portion 30 that is engageable with and secured to an inner portion 32 of such at least one of the male connection member and the female connection member of such articulated coupling arrangement. In the presently preferred embodiment, an axially opposed second edge portion 34 of such bottom wall portion 14 of apparatus 10 defines one extreme outer edge of such at least one of the male connection member and the female connection member adjacent a lower portion thereof.

The top wall portion 16 of such apparatus 10 has a predetermined length which extends inwardly into such center sill member 20 from such outer edge 22 thereof. The predetermined length of the top wall portion 16 is substantially shorter than the predetermined length of such bottom wall portion 14. Generally, such predetermined length of such top wall portion 16 will be between less than about one-half and about one-fourth the predetermined length of such bottom wall portion 14. In the preferred embodiment of the invention such predetermined length of the top wall portion 16 will be about one-fourth the predetermined length of the bottom wall portion 14. A predetermined width of such top wall portion 16 will be substantially identical to the inner width of such center sill member 20. Further, such top wall portion 16 has a substantially flat upper surface 36. This upper surface 36 of the top wall portion 16 matingly engages at least one of a substantially flat bottom surface 38 of a horizontally disposed top wall portion 40 of the center sill member 20 and a bottom surface 42 of the railway car body 12. In addition, the top wall portion 16 has a first edge portion 46 which is engaged with and secured to the inner portion 32 of such at least one of the male connection member and the female connection member. An axially opposed second edge portion 46 of such top wall portion 16 will define another extreme outer edge adjacent an upper portion of such at least one of the male connection member and the female connection member in the presently preferred embodiment of the invention.

The pair of axially opposed side wall portions 18 of the apparatus 10 have a predetermined configuration. This predetermined configuration, as will become clear hereinafter, provides enhanced versatility in the securing of such at least one of the male connection members and the female connection member to the outer end of the center sill member 20. Each of such pair of axially opposed side wall portions 18 have a first edge portion 49 thereof engageable with and secured to the inner portion 32 of such at least one of the male connection member and the female connection member. Further, each of the axially opposed side wall portions 18 has a second edge portion 50 thereof which is engageable with and secured to an upper surface 52 of the bottom wall portion 14 adjacent respective outer edges 54 thereof. A third edge portion 56 of such of each pair of axially opposed side wall portions 18 is engaged with and secured to a bottom surface 58 of the top wall portion 16 adjacent respective outer edges 60 thereof. Additionally, each of these axially opposed side wall portions 18 has a fourth outer edge portion, generally designated 70, which in conjunction with the first edge portion 49 and the second edge portion 50 and the third edge portion 56 defines such predetermined configuration to provide the enhanced versatility in securing the articulated coupling arrangement to such center sill member 20 of the railway car body 12. A predetermined portion of a respective outer surface 62 of each of such pair of axially opposed side wall portions 18 is positioned for mating engagement with an inner surface 64 of a respective vertically disposed side wall portion 66 of the center sill member 20.

According to the presently preferred embodiment of the invention, the fourth outer edge portion 70 of each of such pair of axially opposed side wall portions 18 includes a first portion 68 which extends upwardly from and substantially perpendicular to the bottom surface 24 of the bottom wall portion 14 adjacent the second edge portion 34. A second portion 72 of such fourth outer edge portion 70 on each of such pair of axially disposed side wall portions 18 extends downwardly and outwardly from the second edge portion 48 of the top wall portion 16 toward the first portion 68 of such fourth outer edge portion 70. It is also preferred that the fourth outer edge portion 70 includes an arcuate portion 74 which is at least adjacent a point where such first portion 68 and such second portion 72 of the fourth outer edge portion 70 would normally intersect were it not for such arcuate position 74.

At the present time, it is preferred that each of the bottom wall portion 14 and the top wall portion 16 and the pair of axially opposed side wall portions 18 which make up the connection arrangement 10 be formed as an integral single piece unit. It is even more preferred that such connection arrangement 10 be formed integrally with either such male connection member and/or such female connection member as a single piece unit. This arrangement then lends itself to making these components of the articulated coupling arrangement as single piece castings. In this manner, manufacturing cost can be maintained at a more acceptable level. As is relatively clear from the drawings the bottom surface 24 of the bottom wall portion 14 and the upper surface 36 of the top wall portion 16 in combination with the respective outer surfaces 62 of the axially opposed side wall portions 18 form a generally rectangular shaped connection arrangement 10 for such at least one of the male connection member and the female connection member.

In order to best achieve such enhanced versatility in securing such at least one of the male connection member and the female connection members to such center sill member 20, according to the presently preferred embodiment of the invention, at least another predetermined portion 76 of the respective outer surfaces 62 of the axially opposed side wall portion 18 is exposed through at least one cutout portion 78 formed through each of such vertically disposed side wall portions 66 of the center sill member 20. Such cutout portions 78 are conveniently formed as slot-like openings in such side wall portions 66 of the center sill. In these cutout portions 78, the axially opposed side wall portions 18 of the connection arrangement 10 can be welded to such side wall portions 66 of the center sill member 20 thereby providing such enhanced versatility in connecting such articulated coupling arrangement to the center sill member 20.

Furthermore, according to the presently preferred embodiment of the invention, the upper surface 26 of the bottom wall portion 14 which is located between respective inner surfaces 80 of the pair of side wall portions 18 is tapered downwardly and outwardly from such first edge portion 30 thereof toward the axially opposed second edge portion 34 of such bottom wall portion. Such taper is preferably on the order of about 2 degrees. The bottom surface 58 of the top wall portion 16 is also tapered between such respective inner surfaces 80 of such pair of axially disposed side wall portion 18. This portion of the bottom surface 58 of the top wall portion 16 is tapered upwardly and outwardly from the first edge portion 46 of such top wall portion toward the axially opposed second edge portion 48 of such top wall portion 16. Likewise, the respective inner surfaces 80 of each axially opposed side wall portion 18 are tapered outwardly from their respective first edge portion 48 and inwardly toward their respective outer surface 62 adjacent their respective fourth outer edge portion 70.

It is further desirable to provide a cutout portion 44, having predetermined configuration that preferably is shaped like a half-moon, in such bottom wall portion 14. The cutout portion 44 is located adjacent such axially opposed second edge portion 34 of the bottom wall portion 14 and substantially midway between the respective outer edges 54 thereof.

To further enhance the connection arrangement 10 of the present invention, each of such bottom wall portion 14 and such top wall portion 16 and such pair of axially opposed side wall portion 18 will be provided with a tapered portion 82 located adjacent such inner portion 32 of such at least one of the male connection member and the female connection member. Such tapered portion 82 is provided to facilitate the welding of such at least one of the male connection member and the female connection member to such center sill member 20 during installation of the articulated coupling arrangement to adjacent ends of a pair of railway cars. Preferably the tapered portion 82 will have a taper of about 45 degrees.

Although a number of presently preferred and alternative embodiments of the connection arrangement to provide enhanced versatility in connecting at least one of a male connection member and a female connection member of an articulated coupling apparatus to a center sill member of a railway car body have been described in detail above, it will be obvious to those persons who are skilled in the railway coupling art that various other modifications and adaptations of the present invention can be made without departing from the spirit and scope of the appended claims.

We claim:

1. A connection arrangement which provides greatly enhanced versatility in securing at least one of a male connection member and a female connection member of an articulated coupling arrangement to one outer end of a center sill member disposed substantially along a longitudinal axis of a railway car body, said connection arrangement comprising:

(a) a bottom wall portion having a predetermined length and a predetermined width, said predetermined length of said bottom wall portion extending inwardly into such center sill member from an outer edge thereof and said predetermined width being substantially identical to an inner width of such center sill member, said bottom wall portion having a substantially flat bottom surface which matingly engages a substantially flat upper surface of a horizontally disposed bottom wall of such center sill member, said bottom wall portion having a first edge portion thereof engageable with and secured to an inner portion of such at least one of such male connection member and such female connection member;

(b) a top wall portion having a predetermined length and predetermined width, said predetermined length of said top wall portion extending inwardly into such center sill member from such outer edge thereof and said predetermined width being substantially identical to such inner width of such center sill member, said predetermined length of said top wall portion is substantially shorter than said predetermined length of said bottom wall portion, said top wall portion having a substantially flat upper surface which matingly engages at least one of a substantially flat bottom surface of a horizontally disposed top wall portion of such center sill member and a bottom surface of such railway car body, such top wall portion having a first edge portion thereof engageable with and secured to an inner portion of such at least one of such male connection member and such female connection member;

(c) a pair of axially opposed side wall portions having a predetermined configuration which provides said greatly enhanced versatility in securing such at least one of such male connection member and such female connection member to such outer end of such center sill member, each of said pair of side wall portions having a first edge portion engageable with and secured to an inner portion of such at least one of such male connection member and such female connection member, said each of said pair of side wall portions having a second edge portion engageable with and secured to an upper surface of said bottom wall portion adjacent to a respective outer edge thereof, said each of said pair of side wall portions having a third edge portion engageable with and secured to a bottom surface of said top wall portion adjacent a respective outer edge thereof, said each of said pair of side wall portions having a fourth outer edge portion which in conjunction with said first edge portion and said second edge portion and said third edge portion defines said predetermined configuration, a predetermined portion of a respective outer surface of said each of said pair of side wall portions matingly engages an inner surface of a respective vertically disposed side wall portion of such center sill member;

(d) at least another predetermined portion of said respective outer surface of said each of said pair of side wall portions is exposed through at least one cutout portion formed through each such vertically disposed side wall portion of such center sill member; and (e) said fourth outer edge portion of said each of said pair of side wall portions includes a first portion which extends upwardly for a predetermined distance from and substantially perpendicular to said bottom surface of said bottom wall portion and a second portion which extends downwardly and outwardly from said top wall portion for a predetermined distance to an intersection with said first portion of said fourth outer edge portion.

2. A connection arrangement which greatly enhances versatility in securing an articulated coupling arrangement to a center sill member of a railway car, according to claim 1, wherein an axially opposed second edge portion of said bottom wall portion defines one extreme outer edge of such at least one of such male connection member and such female connection member adjacent a lower portion thereof.

3. A connection arrangement which greatly enhances versatility in securing an articulated coupling arrangement to a center sill member of a railway car, according to claim 2, wherein an axially opposed second edge portion of said top wall portion defines another extreme outer edge adjacent an upper portion of such at least one of such male connection member and such female connection members.

4. A connection arrangement which greatly enhances versatility in securing an articulated coupling arrangement to a center sill member for a railway car according to claim 3, wherein said first portion of said fourth outer edge portion of said each of said pair of side wall portions extends upwardly from and substantially perpendicular to said bottom surface of said bottom wall portion adjacent said second edge portion and said second portion extends downwardly and outwardly from said second edge portion of said top wall portion toward said first portion of said further outer edge portion.

5. A connection arrangement which greatly enhances versatility in securing an articulated coupling arrangement to a center sill member of a railway car, according to claim 4, wherein said fourth outer edge portion includes an arcuate portion at least adjacent a point where said first portion and said second portion of said fourth outer edge portion would intersect.

6. A connection arrangement which greatly enhances versatility in securing an articulated coupling arrangement to a center sill member of a railway car, according to claim 5, wherein said upper surface of said bottom wall portion disposed intermediate respective inner surfaces of said pair of side wall portions is tapered downwardly and outwardly from said first edge portion toward said axially opposed second edge portion.

7. A connection arrangement which greatly enhances versatility in securing an articulated coupling arrangement to a center sill member of a railway car, according to claim 6, wherein said bottom surface of said top wall portion disposed intermediate said respective inner surfaces of said pair of side wall portions is tapered upwardly and outwardly from said first edge portion toward said axially opposed second edge portion.

8. A connection arrangement which greatly enhances versatility in securing an articulated coupling arrangement to a center sill member of a railway car, according to claim 7, wherein said respective inner surfaces of said pair of side wall portions are tapered outwardly from their respective said first edge portion and inwardly toward their respective said outer surface adjacent their respective said fourth outer edge portion.

9. A connection arrangement which greatly enhances versatility in securing an articulated coupling arrangement to a center sill member of a railway car, according to claim 2, wherein said bottom wall portion includes a cutout portion, having a predetermined configuration, located adjacent said axially opposed second edge portion and substantially midway between said respective outer edges thereof to facilitate welding of said connection arrangement to a center sill member of a railway car.

10. A connection arrangement which greatly enhances versatility in securing an articulated coupling arrangement to a center sill member of a railway car, according to claim 9, wherein said predetermined configuration of said cutout portion is shaped like a half-moon.

11. A connection arrangement which greatly enhances versatility in securing an articulated coupling arrangement to a center sill member of a railway car, according to claim 1, wherein each of said bottom wall portion and said top wall portion and said pair of side wall portions include a tapered portion located adjacent such inner portion of such at least one of such male connection member and such female connection member to facilitate welding to such center sill member during installation of such articulated coupling arrangement to adjacent ends of a pair of railway cars.

12. A connection arrangement which greatly enhances versatility in securing an articulated coupling arrangement to a center sill member of a railway car, according to claim 11, wherein said tapered portion on said each of said bottom wall portion and said top wall portion and said pair of side wall portions is tapered at an angle of about 45 degrees.

13. A connection arrangement which greatly enhances versatility in securing an articulated coupling arrangement to a center sill member of a railway car according to claim 1, wherein each of said bottom wall portion and said top wall portion and said pair of side wall portions making up said connection arrangement are formed integrally as a single piece.

14. A connection arrangement which greatly enhances versatility in securing an articulated coupling arrangement to a center sill member of a railway car, according to claim 13, wherein said each of said bottom wall portion and said top wall portion and said pair of side wall portions making up said connection arrangement are formed integrally as a single piece with such at least one of such male connection member and said female connection member.

15. A connection arrangement which greatly enhances versatility in securing an articulated coupling arrangement to a center sill member of a railway car, according to claim 1, wherein said predetermined length of said top wall portion is less than one-half said predetermined length of said bottom wall portion.

16. A connection arrangement which greatly enhances versatility in securing an articulated coupling arrangement to a center sill member of a railway car, according to claim 15, wherein said predetermined length of said top wall portion is about one-fourth of said predetermined length of said bottom wall portion.

17. A connection arrangement which greatly enhances versatility in securing an articulated coupling arrangement to a center sill member of a railway car, according to claim 1, wherein said bottom surface of said bottom wall portion and said top surface of said top wall portion and said respective outer surface of said each of said pair of side wall portions form a generally rectangular shaped connection arrangement.

* * * * *

UNITED STATES PATENT AND TRADEMARK OFFICE

CERTIFICATE OF CORRECTION

PATENT NO. : 5,167,334

DATED : DECEMBER 1, 1992

INVENTOR(S) : Wajih Kanjo and Michael G. Hawryszkow

It is certified that error appears in the above-identified patent and that said Letters Patent is hereby corrected as shown below:

Column 5, line 63, delete "members" and insert --member--;

line 66, after 3, insert --is--.

Column 7, line 36, after of, first occurrence, delete "such" and insert --each--;

line 36, after of, second occurrence, delete "each" and insert --such--.

Column 8, line 58, delete "48" and insert --49--.

Signed and Sealed this

Twenty-first Day of December, 1993

Bruce Lehman

*Attest:*

BRUCE LEHMAN

*Attesting Officer*

*Commissioner of Patents and Trademarks*